US010247508B2

(12) United States Patent
Tolstykh

(10) Patent No.: US 10,247,508 B2
(45) Date of Patent: Apr. 2, 2019

(54) AIR DISTRIBUTION DEVICE FOR A DUAL BARREL PNEUMATIC GUN

(71) Applicant: Boris B. Tolstykh, Solon, OH (US)

(72) Inventor: Boris B. Tolstykh, Solon, OH (US)

( * ) Notice: Subject to any disclaimer, the term of this patent is extended or adjusted under 35 U.S.C. 154(b) by 0 days.

(21) Appl. No.: 15/709,914

(22) Filed: Sep. 20, 2017

(65) Prior Publication Data

US 2018/0142983 A1 May 24, 2018

Related U.S. Application Data

(60) Provisional application No. 62/423,944, filed on Nov. 18, 2016.

(51) Int. Cl.
*F41B 11/72* (2013.01)
*F41B 11/723* (2013.01)
*F41A 21/06* (2006.01)

(52) U.S. Cl.
CPC ..... *F41B 11/723* (2013.01); *F41A 21/06* (2013.01)

(58) Field of Classification Search
CPC ..... F41B 11/00; F41B 11/723; F41B 21/06
USPC ..... 124/59
See application file for complete search history.

(56) References Cited

U.S. PATENT DOCUMENTS

| | | | | |
|---|---|---|---|---|
| 5,878,734 | A * | 3/1999 | Johnson | F41B 11/54 124/59 |
| 6,067,975 | A * | 5/2000 | Ginn | F41B 11/64 124/59 |
| 9,200,866 | B1 * | 12/2015 | Lin | F41B 11/721 |
| 2011/0146645 | A1 * | 6/2011 | Ma | F41B 11/64 124/59 |
| 2013/0239938 | A1 * | 9/2013 | Nugent | F41B 11/55 124/59 |
| 2013/0319389 | A1 * | 12/2013 | Cho | F41B 11/70 124/73 |

* cited by examiner

*Primary Examiner* — Joshua E Freeman
(74) *Attorney, Agent, or Firm* — Buckingham, Doolittle & Burroughs, LLC

(57) ABSTRACT

An air distribution device for a dual barrel air gun is disclosed that routes air or other gases exhausted from an air gun tank to a select one of the air gun barrels which allows the user to fire a follow up shot with less delay. More specifically, the device of the present invention allows the user to control the routing of air to either barrel of the air gun through the use of a stem selector, a first transfer port and a second transfer port.

11 Claims, 10 Drawing Sheets

AIR DISTRIBUTION DEVICE FOR A DUAL BARREL PNEUMATIC GUN

CROSS-REFERENCE

This application claims priority from Provisional Patent Application Ser. No. 62/423,944 filed Nov. 18, 2016.

FIELD OF THE INVENTION

This invention pertains generally to an air distribution device for a dual barrel air gun that enables the user to selectively route the compressed air or other gases that are used to propel a BB, pellet or other projectile to either barrel of the dual barrel air gun.

BACKGROUND

Many air gun enthusiasts enjoy firing air guns. An air gun fires a projectile such as a pellet or a BB using a compressed air or other gas, and a dual barrel air gun has two barrels, each of which is capable of discharging said BB or pellet.

Heretofore, a user of a dual barrel air gun had to pull the trigger of the air gun to discharge a blast of air or other gas through both barrels (see e.g., U.S. Pat. No. 9,200,866), or had to choose a specific trigger to fire from a desired barrel of the air gun (see e.g., U.S. Pat. No. 2,196,732). Neither of said options is particularly appealing to air gun enthusiasts because neither of said options permit a user to selectively fire from one barrel of said air gun with a single trigger.

Consequently, there exists a long felt need in the art for an air distribution device for a dual barrel air gun that enables a user to selectively route the air or other gas to either barrel of the dual barrel air gun with a single trigger. There is also a long felt need in the art for an air distribution device that enables the user to reduce the time between follow up shots. Finally, there is a long felt need in the art for a device that accomplishes all of the forgoing objectives, and that is relatively inexpensive to manufacture and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an air distribution technique and device for a dual barrel air gun, wherein said air distribution device is preferably comprised of: a body portion; a selector stem with a plurality of openings therein; a first transfer port that is capable of aligning with one of said openings so that a blast of air or other gas is capable of passing from said selector stem through said first transfer port; and a second transfer port that is capable of aligning with a different at least one of said plurality of openings so that a blast of air is capable of passing from said selector stem through said second transfer port.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
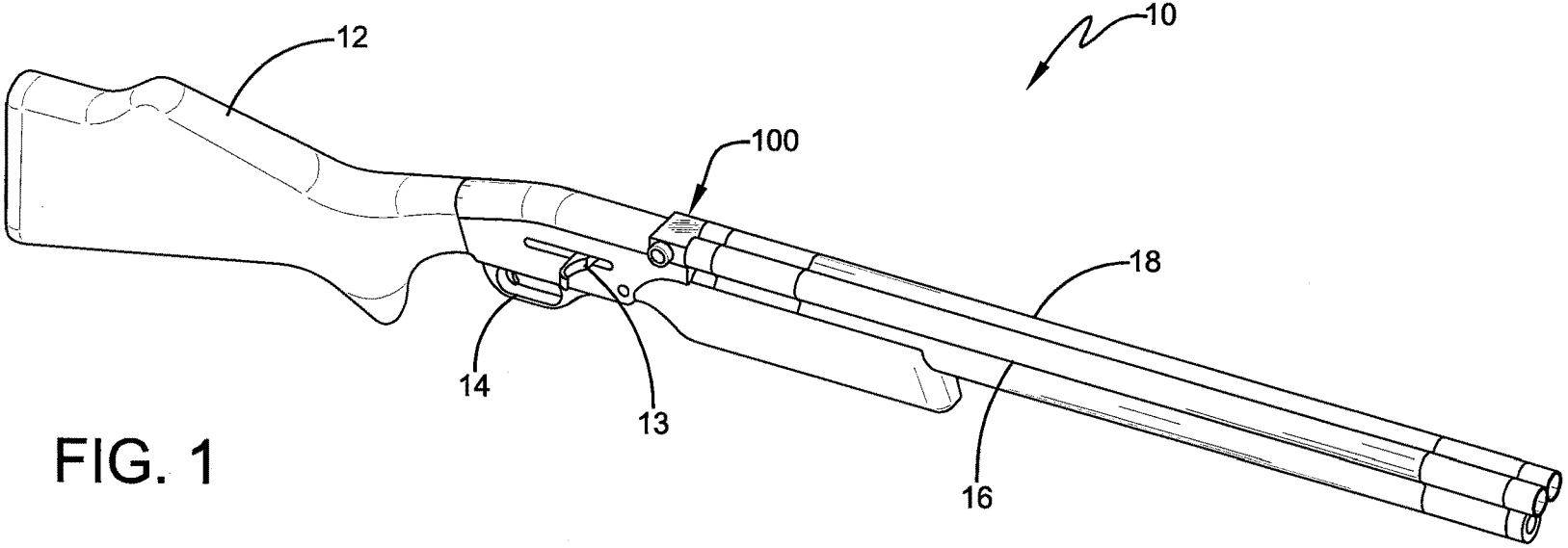
FIG. 1 is a perspective view of a dual barrel air gun with the air distribution device of the invention installed thereon.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention is directed to an air distribution technique and device for a dual barrel air gun. Turning now to the drawings, FIG. 1 depicts the air distribution device 100 of the present invention installed on a dual barrel air gun 10. Air gun 10 is well known in the art and is typically comprised of a stock 12, a cocking lever 13, a trigger mechanism 14, a first barrel 16 and a second barrel 18, typically positioned side by side with first barrel 16. Each of first barrel 16 and second barrel 18 are capable of discharging a projectile (not shown) when cocking lever 13 and trigger mechanism 14 have both been activated, as is well known in the art. However, heretofore, a user of dual barrel air gun 10 had to pull trigger mechanism 14 to simultaneously discharge a blast of air or other gas (not shown) through both first barrel 16 and second barrel 18, or had to choose a specific trigger to fire from a desired first or second barrel 16, 18.

Figure 2:
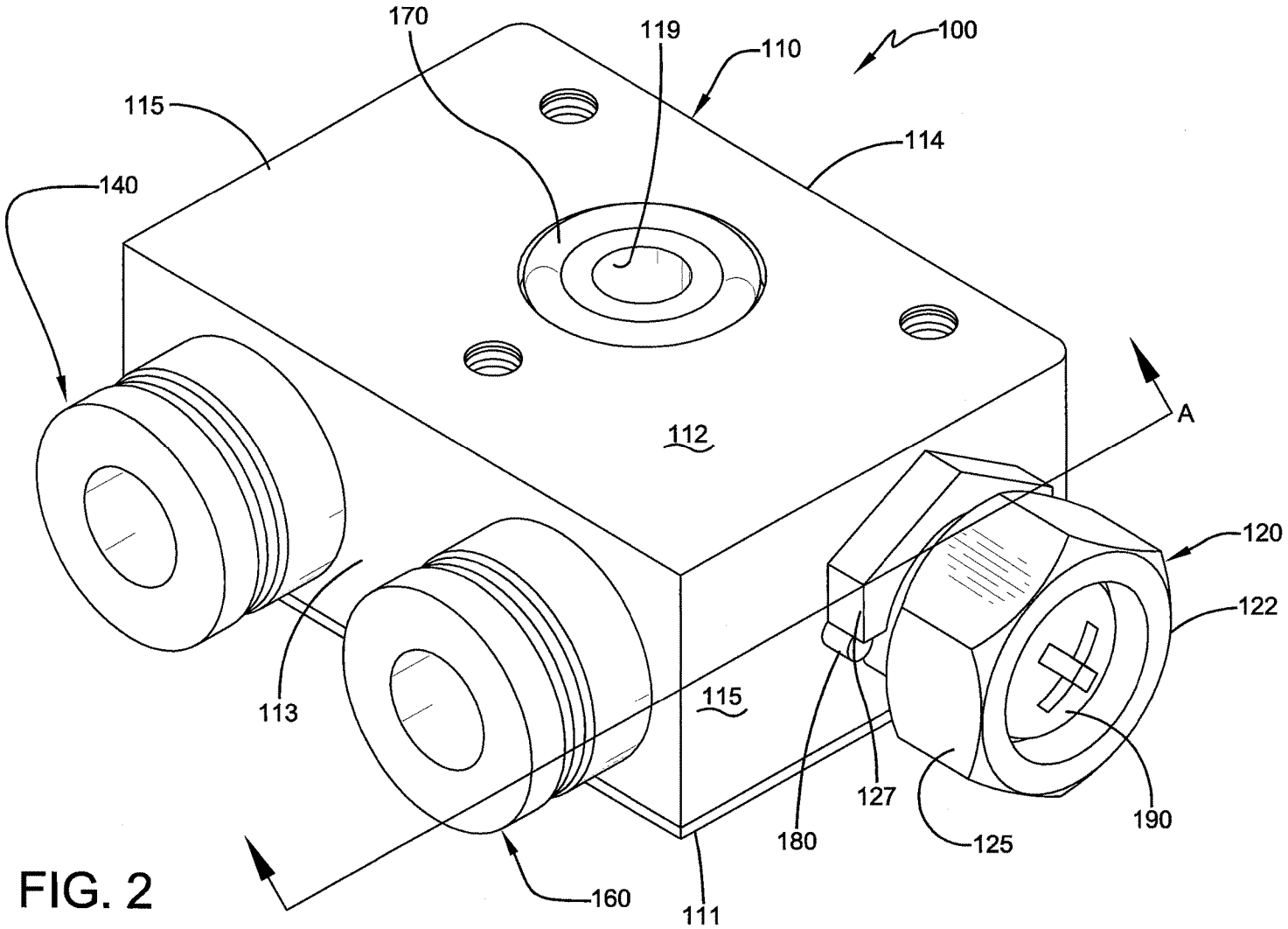
FIG. 2 is a bottom perspective view of a preferred embodiment of the air distribution device of the present invention.
Figure 3:
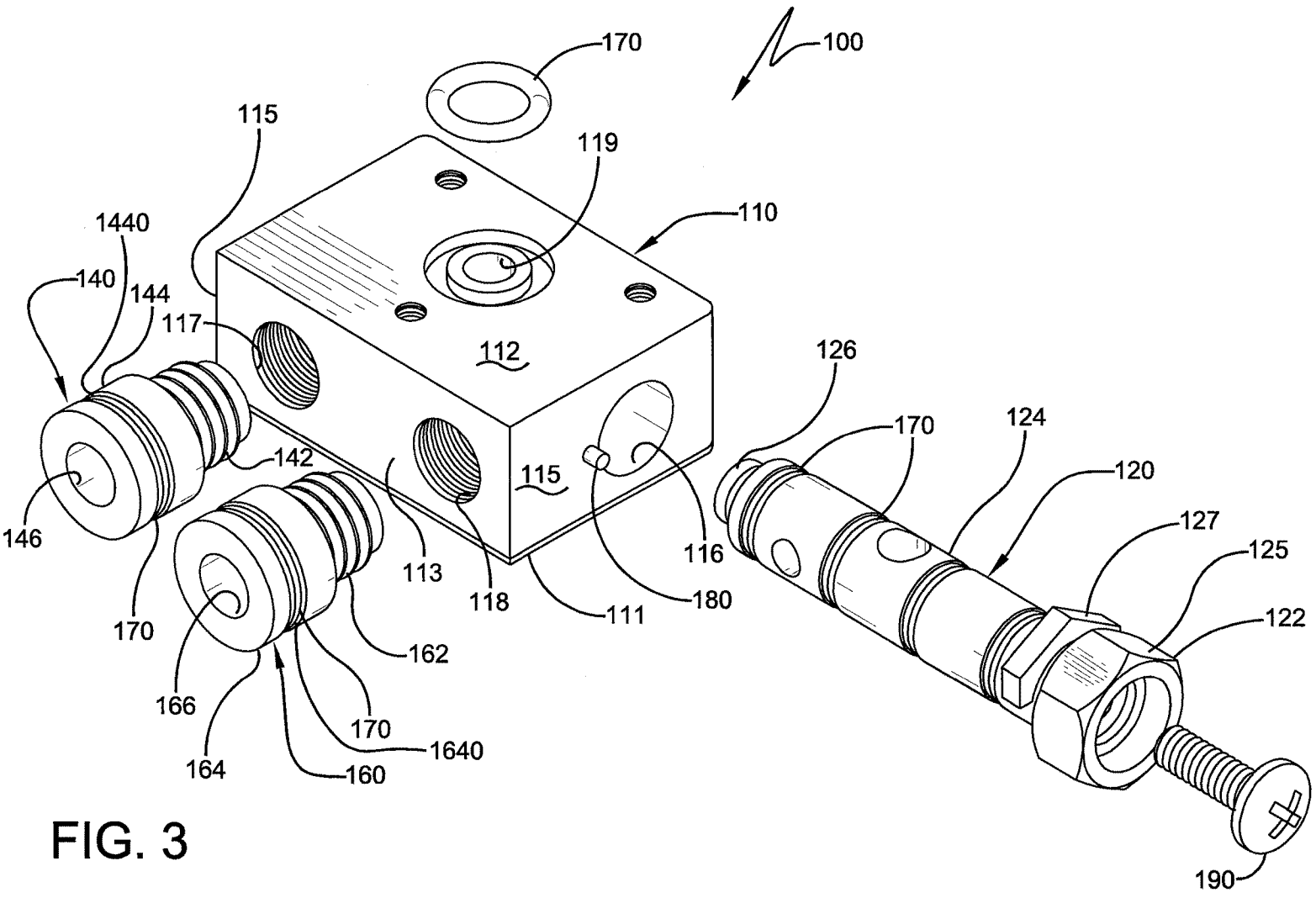
FIG. 3 is a bottom perspective and partially exploded view of the air distribution device shown in FIG. 2.
Figure 4:
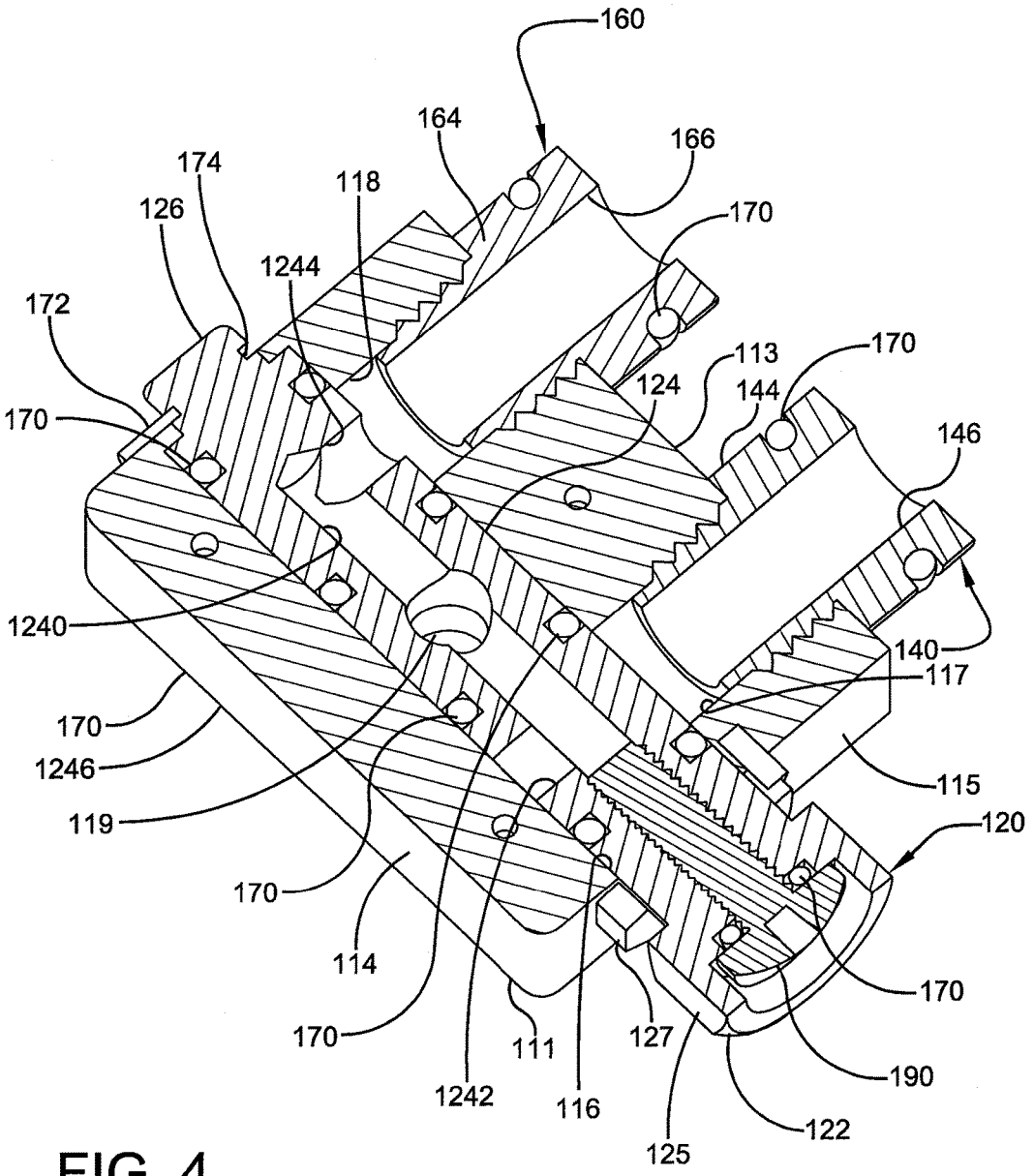
FIG. 4 is a top perspective view of the air distribution device shown in FIG. 2 at cut line A-A.

As best shown in FIGS. 2-4, device 100 is preferably comprised of a body portion 110, a selector stem 120, a first transfer port 140, and a second transfer port 160. Body portion 110 is a generally rectangular block comprised of a top 111, a bottom 112, a front 113, a back 114, opposing sides 115, an opening 116 that extends between said opposing sides 115 for receipt of said selector stem 120, a first port opening 117 that extends from said opening 116 to said front 113, a second port opening 118 that extends from said opening 116 to said front 113 and is generally parallel to and spaced apart from said first port opening 117, and an air intake opening 119 that extends between said bottom 112 and said opening 116. First port opening 117 and second port opening 118 are preferably partially threaded for receipt of a portion of first transfer port 140 and second transfer port 160, respectfully, as described more fully below. Air intake opening 119 is in air communication with an air gun tank (not shown) or other device for providing a burst of compressed air or other pressurized gas to dual air gun 10, as is well known in the art.

Figure 5:
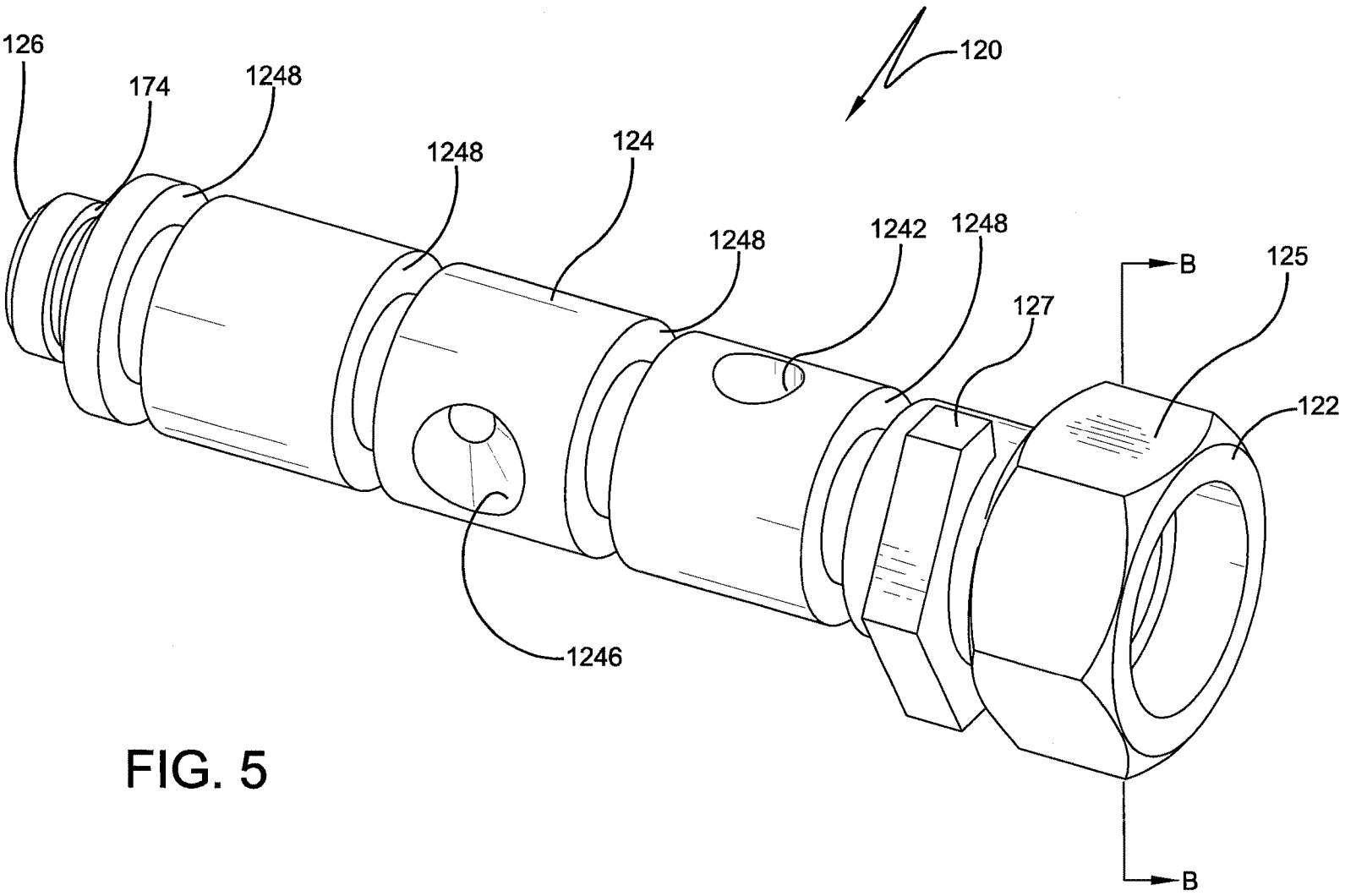
FIG. 5 is a perspective view of the stem selector of the present invention.
Figure 6:
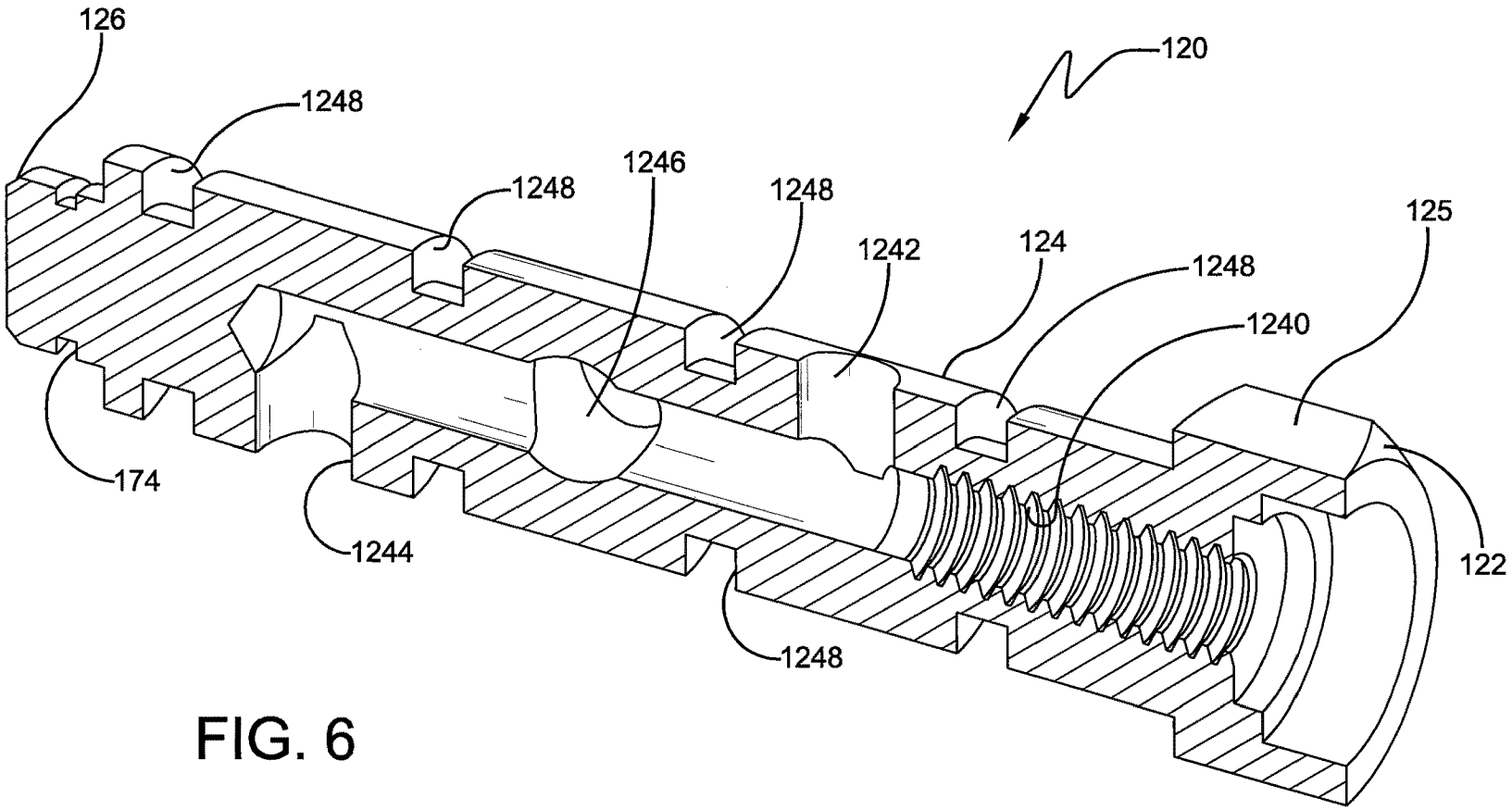
FIG. 6 is a perspective view of the stem selector shown in FIG. 5 at cut line B-B.

As best illustrated in FIGS. 5-6, selector stem 120 is preferably a generally cylindrical, elongated member comprised of a first end 122, a body 124 and a second end 126. As shown in FIG. 6, body 124 is preferably comprised of a bore or longitudinal opening 1240 that extends from first end 122 in the direction of second end 126, a first continuous opening 1242 extending outwardly from opening 1240, a second continuous opening 1244 extending outwardly from opening 1240 in a direction that is different from first continuous opening 1242, and a port opening 1246 that extends outwardly from opening 1240 in a direction that is preferably different from both first continuous opening 1242 and second continuous opening 1244. Body portion 124 may also comprise a plurality of spaced apart grooves 1248 for receipt of an O-ring 170, as best shown in FIGS. 3-4. The O-rings 170 associated with the device 100 of the present invention help to prevent or reduce the unwanted loss of pressurized air or other gasses that may otherwise be used to propel a projectile from dual air gun 10.

In a preferred embodiment of the present invention, selector stem 120 further comprises a handle 125 and a chock 127, as best shown in FIG. 5. Handle 125 is preferably positioned at first end 122 and may include markings thereon (e.g., "R" and "L", "1" and "2", etc.) so that a user can select the appropriate barrel to discharge from, as explained more fully below.

Selector stem 120 is generally restricted from axial (longitudinal) movement by a retainer 172. Retainer 172 is installed in a groove 174 in stem selector 120, preferably near second end 126. In this manner, movement of stem selector 120 is generally limited to partial rotation around its longitudinal axis to allow alignment between corresponding openings 1242, 1244, transfer ports 140, 160 and ultimately barrels 16, 18. More specifically, chock 127 extends outwardly from and partially around the exterior surface of body 124 in the general vicinity of handle 125. As best shown in FIG. 2, a pin 180 may extend outwardly from side 115 to partially limit the rotational movement of chock 127 when a user (not shown) attempts to rotate selector stem 120 within longitudinal opening 1240, as more fully described below. A self-sealing screw 190 may also be positioned at first end 122 and extend inwardly into longitudinal opening 1240 in the direction of second end 126. Self-sealing screw 190 prevents the compressed air or other gas from escaping from longitudinal opening 1240.

First transfer port 140 is preferably a generally cylindrical, elongated member comprised of a first threaded insert 142 for mating with first port opening 117, a first barrel insert 144 for insertion into an end of first barrel 16, and a continuous opening 146 that extends longitudinally through first transfer port 140, thereby providing a possible air passageway between device 100 and first barrel 16. First barrel insert 144 may further comprise a circumferential groove 1440 therein for receipt of O-ring 170, as best shown in FIG. 3, to create an airtight connection when inserted into first barrel 16.

Second transfer port 160 is preferably substantially similar in size, shape and function as first transfer port 140 and is comprised of a second threaded insert 162 for mating with second port opening 118, a second barrel insert 164 for insertion into an end of second barrel 18, and a continuous opening 166 that extends longitudinally through second transfer port 160, thereby providing a possible air passageway between device 100 and second barrel 18. Second barrel insert 164 may further comprise a circumferential groove 1640 therein for receipt of O-ring 170, as best shown in FIG. 3, to create an airtight connection when inserted into second barrel 18.

Figure 7A:
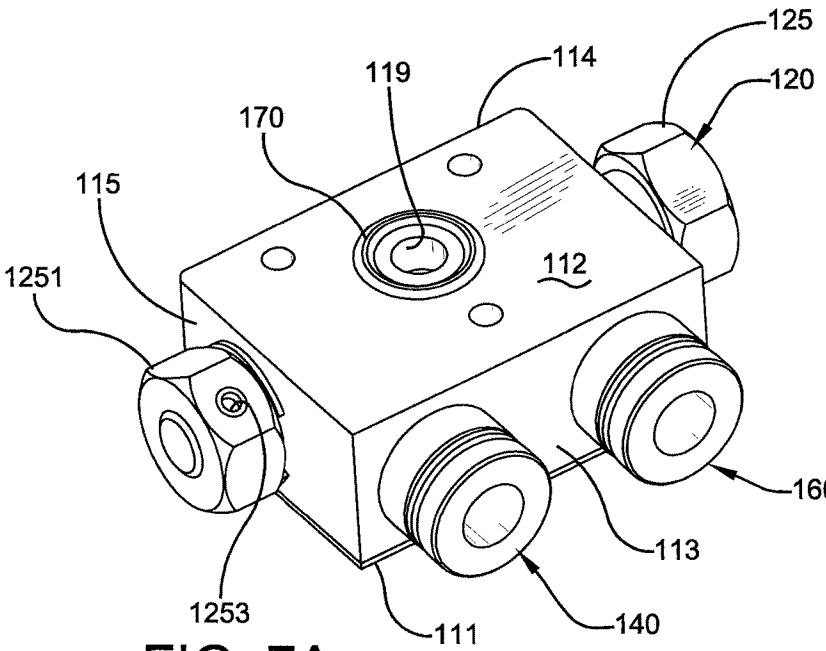
FIG. 7A is a bottom perspective view of an alternative embodiment of the air distribution device of the present invention with two handles.

FIGS. 7A and B are bottom perspective views of an alternative embodiment of the device of the present invention in which device 100 is comprised of a second handle 1251 positioned at the opposite end of selector stem 120 as that of handle 125. Second handle 1251 is further comprised of an opening 1252 therein for receipt of a set screw 1253 which may be used to attach second handle 1251 to selector stem 120. Similar to handle 125, second handle 1251 may include markings thereon (e.g., "R" and "L", "1" and "2", etc.) so that a user can select the appropriate barrel to discharge from, as explained more fully below, regardless of whether the user is right-handed or left-handed. FIG. 8 is a perspective view of the second handle 1251 of the device 100 depicted in FIGS. 7A and 7B.

Figure 9:
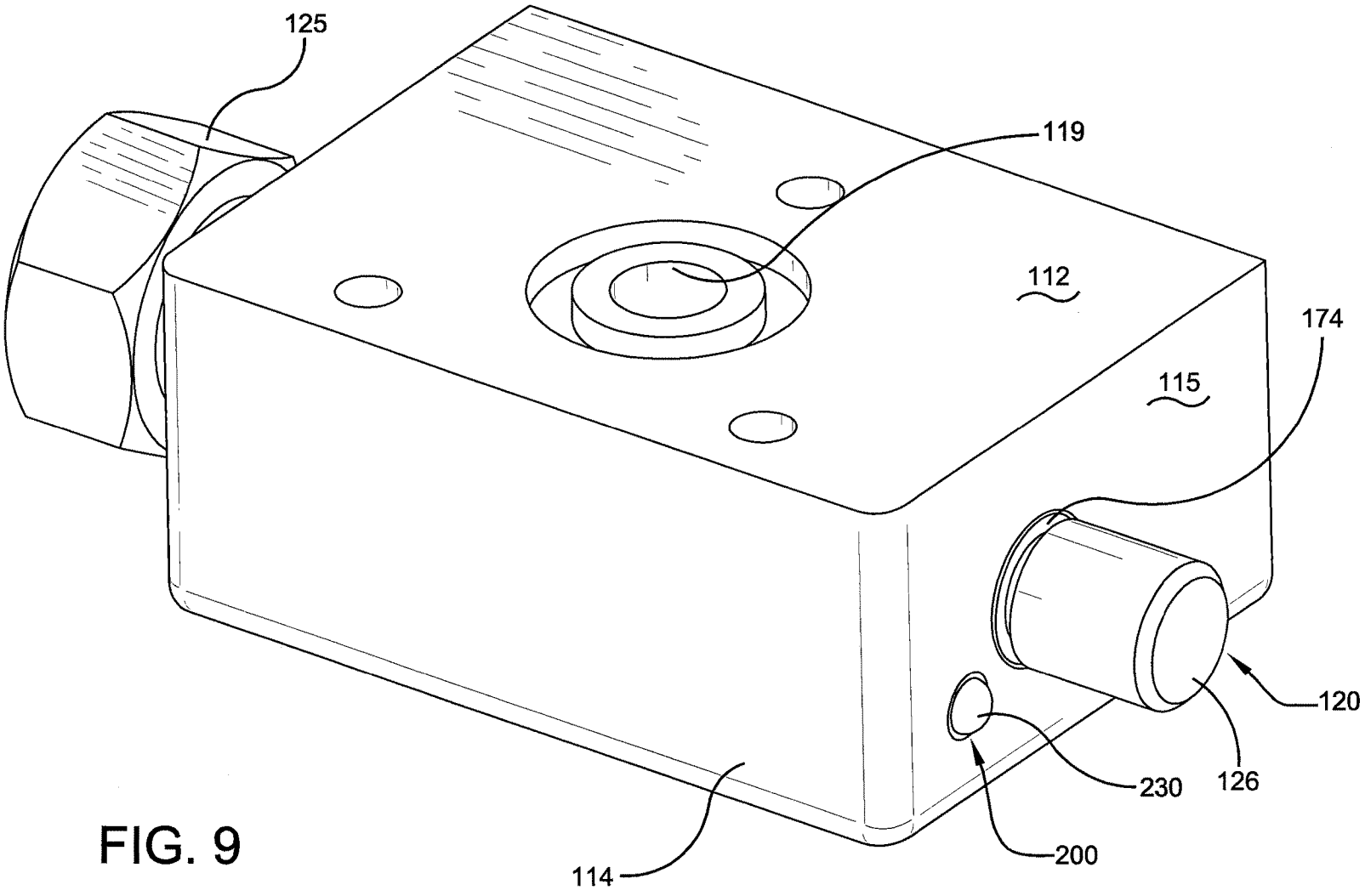
FIG. 9 is a bottom perspective view of a further alternative embodiment of the air distribution device of the present invention.
Figure 10:
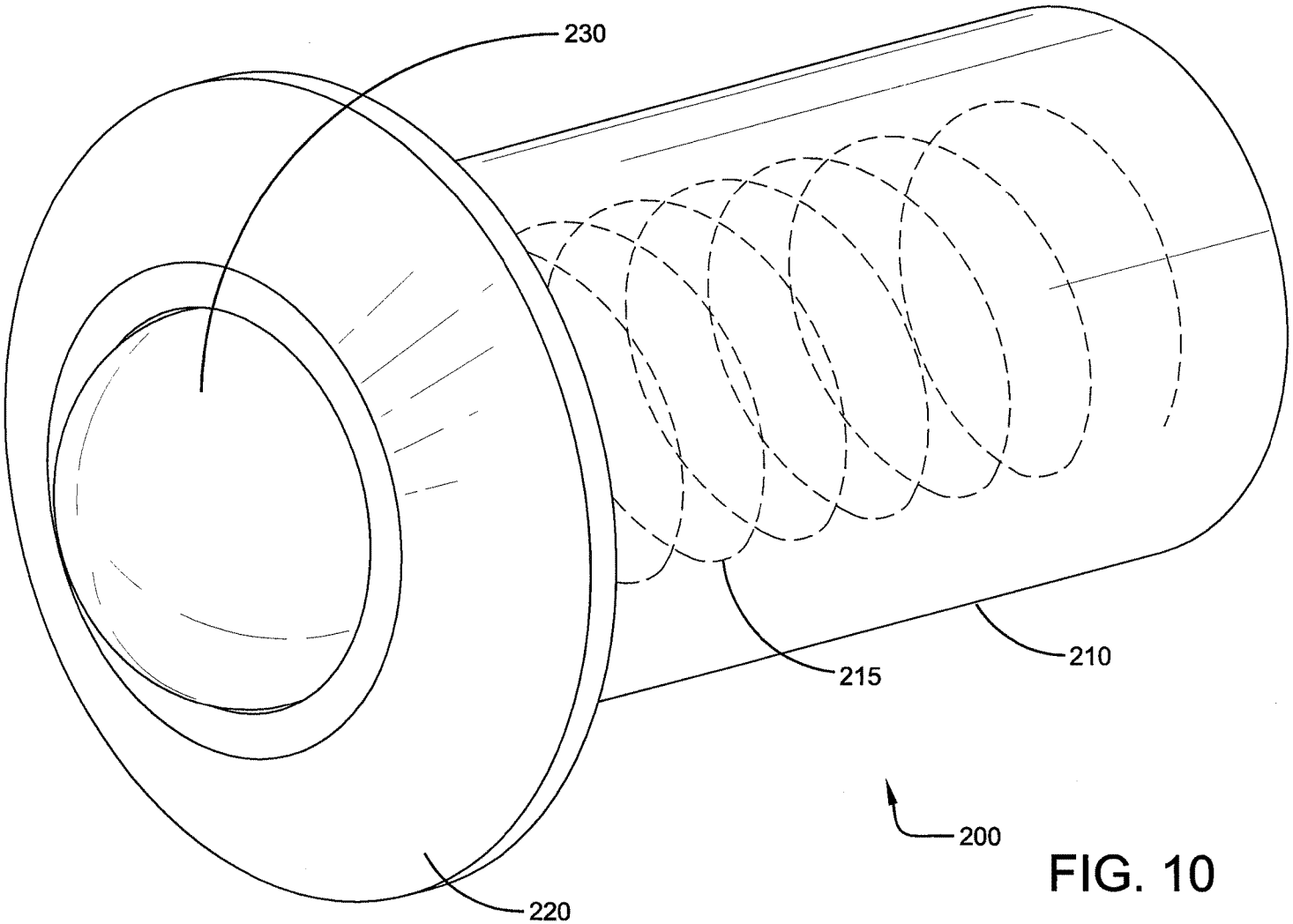
FIG. 10 is a perspective view of the barrel selection indicator of the air distribution device depicted in FIG. 9.

FIG. 9 is a bottom perspective view of an alternative embodiment of device 100, which further comprises a barrel selection indicator 200 which alerts the user (not shown) when the action of selecting a desired barrel 16, 18 to fire a projectile from has been completed. FIG. 10 is a perspective view of barrel selection indicator 200, which is comprised of a body portion 210 for, among other things, housing a spring 215, a retainer 220 and a button 230.

Having described the structure of air distribution device 100, its use will now be generally described. A user (not shown) desiring to, for example, discharge a projectile (not shown) from the first barrel 16 of dual barrel air gun 10 will simply rotate selector stem 120 until the "R" marking on handle 125 (or second handle 1251) is facing user (who would be positioned immediately adjacent to stock 12 of dual air gun 10) and pin 180 prevents chock 127 and selector stem 120 from further rotating in the initial direction. When the "R" (or other indicia) is in this particular position, first continuous opening 1242 in selector stem 120 is aligned and in air communication with first transfer port 140 and allows the air or other gas (not shown) to be discharged from an air gun tank (not shown) through first continuous opening 1242 in selector stem 120, first transfer port 140 and into first barrel 16 which, in turn, propels a load (e.g., a BB, pellet, arrow or some other projectile) through first barrel 16 and towards its intended target.

The user can then immediately rotate handle 125 (or second handle 1251) in the opposite direction until the "L" marking is facing user (who would still be positioned immediately adjacent to stock 12 of dual air gun 10) and pin 180 prevents chock 127 and selector stem 120 from further rotating. When the "L" is in this particular position, second continuous opening 1244 in selector stem 120 is aligned and in air communication with second transfer port 160 and allows the air or other gas (not shown) to be discharged from an air gun tank (not shown) through second continuous opening 1244 in selector stem 120, second transfer port 160 and into second barrel 18 which, in turn, propels the load or projectile through second barrel 18 and towards its intended target. As an important aspect of the present invention, it is worth noting that when first continuous opening 1242 in selector stem 120 is aligned and in air communication with first transfer port 140, second continuous opening 1244 in selector stem 120 is not aligned nor is it in air communication with second transfer port 160, and vice versa, so that compressed air or other gasses are not discharged through the unselected barrel.

Figure 7B:
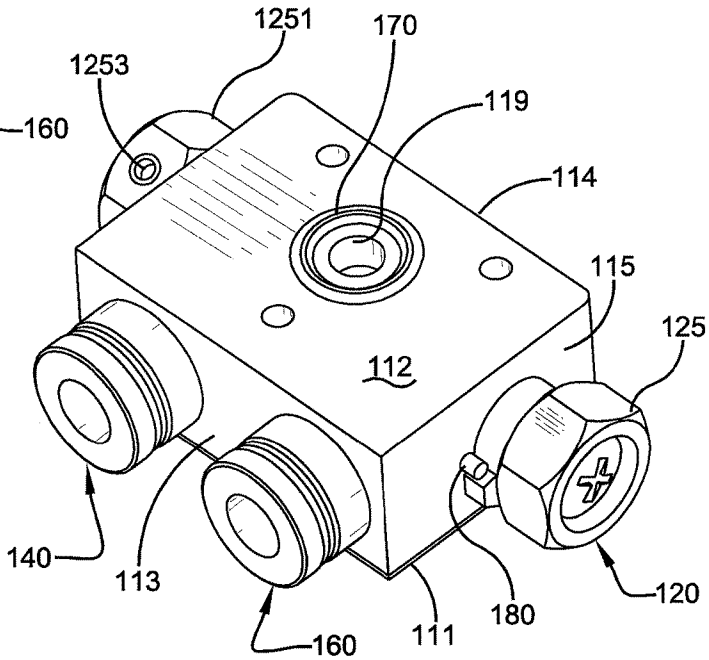
FIG. 7B is a bottom perspective view of the alternative embodiment of the device shown in FIG. 7B.
Figure 8:
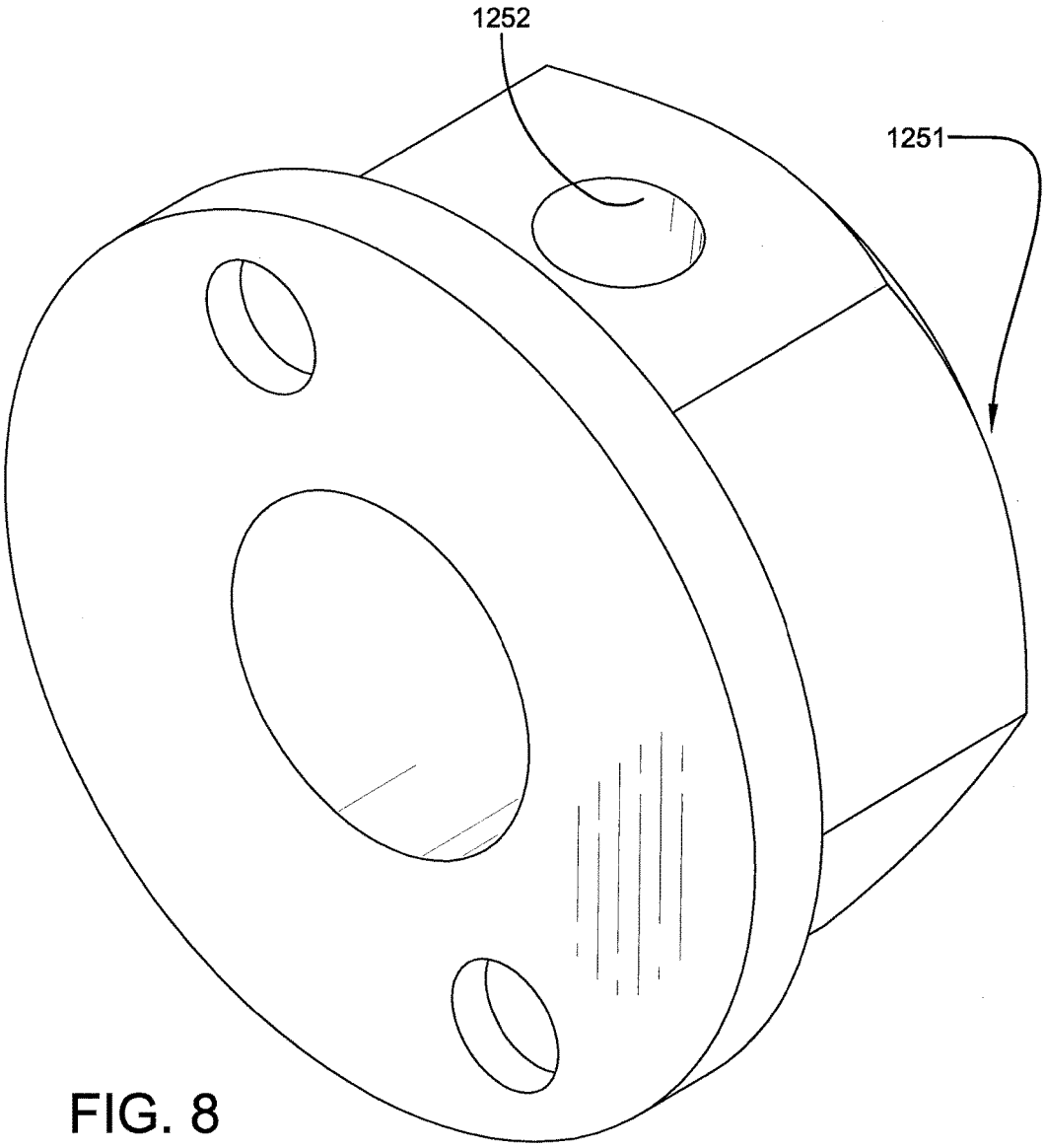
FIG. 8 is a perspective view of the second handle of the air distribution device depicted in FIGS. 7A and 7B.

The alternative embodiments of the present invention will function in a substantially similar manner as described above, except that the embodiment depicted in FIGS. 7A and 7B also offers the user the ability to rotate stem selector 120 from either side of device 100 (which users that are right handed or left handed can appreciate) and the device 100 depicted in FIGS. 9 and 10 also allows the user to lock stem selector 120 in a desired position.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An air distribution device for a dual barrel air gun, wherein said air distribution device is comprised of:

a body portion comprised of a bottom and an air intake opening positioned along said bottom;

a selector stem;

a first transfer port; and a second transfer port.

2. The air distribution device of claim 1 wherein said selector stem is repositionable between a first position and a second position.

3. The air distribution device of claim 2 wherein a blast of air is dischargeable through said selector stem and said first transfer port when said selector stem is in the first position.

4. The air distribution device of claim 2 wherein a blast of air is dischargeable through said selector stem and said second transfer port when said selector stem is in the second position.

5. The air distribution device of claim 1, wherein the body portion further comprises an opening, a first port opening and a second port opening.

6. The air distribution device of claim 5, wherein said selector stem is positioned at least partially within said opening.

7. The air distribution device of claim 1, wherein said selector stem is repositionable to place said air intake opening in air communication with either first transfer port or second transfer port.

8. An air distribution device for a dual barrel air gun, wherein said air distribution device is comprised of:

a body portion comprised of an air intake opening, a first port opening and a second port opening;

a selector stem comprised of a first continuous opening and a second continuous opening;

a self-sealing screw and at least one o-ring;

a first transfer port; and a second transfer port.

9. The air distribution device of claim 8, wherein said first continuous opening is capable of being in air communication with each of said air intake opening and a continuous opening in said first transfer port.

10. The air distribution device of claim 8, wherein said second continuous opening is capable of being in air communication with each of said air intake opening and a continuous opening in said second transfer port.

11. The air distribution device of claim 8 further comprising a pin and a retainer, and wherein said selector stem further comprises a handle.

* * * * *